US009903112B2

(12) United States Patent
Lanwehr

(10) Patent No.: US 9,903,112 B2
(45) Date of Patent: Feb. 27, 2018

(54) PARTITIONING WALL ELEMENT

(71) Applicant: DORMA Deutschland GmbH, Ennepetal (DE)

(72) Inventor: Thomas Lanwehr, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 15/169,223

(22) Filed: May 31, 2016

(65) Prior Publication Data

US 2016/0348363 A1 Dec. 1, 2016

(30) Foreign Application Priority Data

Jun. 1, 2015 (DE) ..... 10 2015 108 663

(51) Int. Cl.
*E04B 2/82* (2006.01)
*E06B 3/46* (2006.01)

(52) U.S. Cl.
CPC ..... *E04B 2/827* (2013.01); *E04B 2/825* (2013.01); *E04B 2/828* (2013.01); *E06B 3/4636* (2013.01)

(58) Field of Classification Search
CPC ..... E04B 2/827; E04B 2/825; E04B 2/828; E06B 3/4636
See application file for complete search history.

(56) References Cited

U.S. PATENT DOCUMENTS 3,566,559 A * 3/1971 Dickson ..... E04B 2/824 52/126.4
4,103,463 A * 8/1978 Dixon ..... E04B 2/824 52/126.4
4,277,920 A * 7/1981 Dixon ..... E04B 2/824 49/321
4,454,690 A * 6/1984 Dixon ..... E04B 2/824 52/126.3
4,833,840 A * 5/1989 Kalischewski ..... E04B 2/82 160/197
5,167,575 A * 12/1992 MacDonald ..... E04B 2/827 454/187
5,228,254 A * 7/1993 Honeycutt, Jr. ..... E04B 2/825 52/241

(Continued)

FOREIGN PATENT DOCUMENTS

DE 7629217 U1 * 1/1977 ..... E04B 2/827
DE 3425484 A1 1/1986

(Continued)

OTHER PUBLICATIONS

German Office action for related application No. 10 2015 108 663.8 dated Oct. 27, 2015 (7 pages).*

*Primary Examiner* — Rodney Mintz
(74) *Attorney, Agent, or Firm* — Cantor Colburn LLP

(57) ABSTRACT

A partitioning wall element for a partitioning wall installation includes a telescoping element, which is deployable in a horizontal direction. The telescoping element includes a pressure beam and a screening profile, wherein the screening profile is retained in or at the pressure beam. The screening profile includes at least one first screening holding component, which, in particular in a latching manner, cooperates with at least one corresponding pressure beam holding component of the pressure beam.

12 Claims, 6 Drawing Sheets

(56) References Cited

U.S. PATENT DOCUMENTS

| | | | | |
|---|---|---|---|---|
| 5,644,877 | A * | 7/1997 | Wood | E04B 2/7407 52/126.3 |
| 9,506,246 | B2 * | 11/2016 | Joseph | E06B 3/5821 |
| 2003/0140591 | A1 * | 7/2003 | Scherrer | E04B 2/825 52/716.1 |
| 2015/0376899 | A1 * | 12/2015 | Joseph | E04B 2/7401 52/241 |
| 2015/0376900 | A1 * | 12/2015 | Joseph | E06B 3/5821 52/241 |

FOREIGN PATENT DOCUMENTS

| | | | | |
|---|---|---|---|---|
| DE | 9200754 | U1 * | 4/1992 | E04B 2/82 |
| DE | 102015108663 | A1 * | 12/2016 | E04B 2/825 |

* cited by examiner

PARTITIONING WALL ELEMENT

CROSS-REFERENCE TO RELATED APPLICATIONS

This application is related to and claims the benefit of German Patent Application No. DE 102015108663.8, filed on Jun. 1, 2015, the contents of which are herein incorporated by reference in their entirety.

TECHNICAL FIELD

This disclosure relates to a partitioning wall element for a partitioning wall installation, wherein the partitioning wall element includes a telescoping element, which is deployable in a horizontal direction. The disclosure likewise relates to a partitioning wall installation.

BACKGROUND

Different embodiments of partitioning wall installations are known. Generally, a partitioning wall installation comprises several partitioning wall elements. Disposed next to each other, together the partitioning wall elements may form a partitioning wall.

In one partitioning wall element, which forms a lateral end of the partitioning wall, a border-sided telescoping element is provided, which is deployable by means of a drive device. When closing the partitioning wall, the telescoping element is horizontally deployable against a stationary building wall or the like, with the intention to brace the partitioning wall element horizontally against each other and to close the available remaining width of the building opening in question without a gap. As an alternative, the telescoping element is deployed against an attached abutment, in the event, instead of the stationary building wall, another partitioning wall or the like is adjoining, which may not be charged with tensioning forces.

In semi-automated or fully automatic partitioning wall installations or partitioning wall elements, in the following collectively referred to as automatic partitioning wall installations or partitioning wall elements, the telescoping element is usually equipped with safety switches, which, upon contact with an obstacle, interrupt or switch off the motor drive of the telescoping element or of the remaining partitioning wall element. In manually actuated partitioning wall installations or partitioning wall elements, usually such safety switches may be foregone. As a consequence, the partitioning wall element equipped with the telescoping element for a manual partitioning wall installation on the construction level is differently embodied than the partitioning wall element with a telescoping element for automatic partitioning wall installations. This circumstance results in an increased complexity in the multiplicity of variants of such partitioning wall installations and the resulting cost therefrom.

Furthermore, the telescoping elements of manual and automatic partitioning wall elements based on the corresponding different constructions are usually different from each other in their aesthetical appearance, which in particular is not desired when combining manual and automatic partitioning wall elements or partitioning wall installations in one room.

In automatic and manual partitioning wall elements, a drive device is connected to a pressure beam in a complicated manner during manufacturing.

The disclosure provides a partitioning wall element for a partitioning wall installation with a telescoping element, which, in a simple technical manner, produces a particularly aesthetical appealing design of the telescoping lateral surface of the partitioning wall element.

In the preferred embodiments, it is intended to achieve that the multiplicity of variants of the structural groups, which are necessary for building a partitioning wall element, which is equipped with a telescoping element, be reduced and/or the functional safety of such a partitioning wall element be increased.

SUMMARY

The above-disadvantages are addressed and the problem with conventional partitioning wall installations is solved by providing a partitioning wall element for a partitioning wall installation, wherein the wall element includes a telescoping element deployable in a horizontal direction, wherein the telescoping element includes a pressure beam and a screening profile. The screening profile is retained in or at the pressure beam, wherein the screening profile includes at least one first screening holding means, which in a latching manner, cooperates with at least one corresponding pressure beam holding means of the pressure beam.

According to the disclosure, it is intended that the telescoping element comprises a pressure beam and a screening profile, wherein the screening profile is retained in or at the pressure beam, wherein the screening profile comprises at least one first screening holding means, which cooperates with at least one corresponding pressure beam holding means of the pressure beam.

In addition to the pressure beam, the telescoping element comprises a screening profile, which at least partially, preferably completely covers the pressure beam. In this case, the screening profile preferably forms at least partially the telescoping lateral surface of the partitioning wall element. As the screening profile is intended, the pressure beam may be configured in a simple manner as technically required, without having to take into consideration the aesthetical appearance. For example, necessary screw connections in the partitioning wall element, may be realized at the pressure beam, which will be then covered by the screening profile. As the screening profile is retained at the pressure beam, the screening profile is attached in a technically simple manner to the rest of the telescoping element. By means of retaining the screening profile, the pressure beam provided in the telescoping element for telescoping is assigned an additional function. It is thus particularly advantageous, that the screening profile and the pressure beam comprise the retaining means required therefore. Thus, in a technical simple manner, a particularly aesthetically pleasing design of the lateral surface of the partitioning wall element is achieved.

The screening holding means and the pressure beam holding means may non-positively and/or positively cooperate. Preferably, the screening holding means and the pressure beam holding means cooperate in a positive manner, i. e. latching manner.

For a latching in the sense as employed in this case, it is sufficient that a form closure, i. e. a latching in one spatial direction is realized, in particular in a telescoping direction. Therefore, the latching may be configured in that the screening profile is disposed to be immobile in or at the pressure beam or in that the screening profile is configured to be mobile, in particular with regard to the distance between the pressure beam and the screening profile and/or in the vertical direction.

In the following, indications of space and location, such as "vertical", "horizontal", "frontal", "back", "lateral", "telescoping direction" are employed as a viewer of a mounted partitioning wall installation would use said indications of space and location.

Preferably, at least two screening holding means, i. e. a first screening holding means and a second screening holding means are provided, which in particular cooperate in a latching manner with at least two pressure beam holding means corresponding thereto. As long as not indicated otherwise, the features, which refer to the screening holding means and/or to the pressure beam holding means, also refer to the at least two screening holding means and/or to the at least two pressure beam holding means.

The inventive partitioning wall installation may comprise one or more partitioning wall element/s, which is/are disposed to be movable along a displacement path. The displacement path may be defined in particular by means of ceiling-sided and/or floor-sided tracks, in which the one or more partitioning wall element/s is/are guided. Together the partitioning wall elements may form a partitioning wall. Preferably, in the partitioning wall installation with the partitioning wall being dismounted, the partitioning wall elements may be stowed parallel with regard to each other. However, in the mounted condition of the partitioning wall, the partitioning wall elements are lined up closely next to each other in one row. Preferably, the partitioning wall elements are braced by means of sealing strips, which are deployed against the ceiling and/or against the floor.

An inventive partitioning wall element preferably includes running rollers for the displacement in the tracks of the partitioning wall installation. The partitioning wall element may include encasing panels, by means of which the predominant part of a frontal and backside of the partitioning wall element is formed. A space may be formed between the encasing panels. The partitioning wall element may include at least one sealing strip, preferably two sealing strips to be braced against the ceiling and/or the floor.

In a fully automatic partitioning wall element, the displacement of the partitioning wall element and the deployment of the telescoping element are realized by motor, whereas both will be performed manually by an operator in a manually operated partitioning wall element. In a semi-automatic partitioning wall element, the partitioning wall element will be manually displaced, whereas the telescoping element is deployed by motor. The deployment by motor may be realized by means of an electric motor, i. e. electrically.

The telescoping element serves to be deployed in a horizontal direction. Thus, the telescoping element may occupy a retracted and a deployed condition. In the deployed condition, a gap, which existed in the retracted condition between the partitioning wall element and a stationary element, e. g. a building wall, may be bridged. Thus, the telescoping element forms an end-sided connection. Preferably, the telescoping element has covering panels. The covering panels may form at least partially the front and backsides of the telescoping element. In particular, at least in the retracted condition, the covering panels overlap the telescoping element with the encasing panels. In this case, on the one hand, the covering panels may surround the encasing panels. Thus, in the retracted condition, the telescoping element partially accommodates the encasing panels therein. As an alternative, in the retracted condition, the covering panels may be located within the encasing panels. Thus, in this case in the retracted condition the telescoping element is accommodated between the covering panels.

The pressure beam serves as a connection of the drive device to the covering panels. The drive device serves for deploying the telescoping element. The drive device may include one or more deployment units. The pressure beam may extend in such a manner in the vertical that the covering panels are deployable. It is for example conceivable that the pressure beam extends between 40% and 100%, preferably between 60% and 100%, particularly preferred between 75% and 100% over the vertical height of the covering panels. The pressure beam may include a frontal surface oriented towards a lateral surface of the partitioning wall element. The drive device may be embodied to be manually operable or operable by motor.

It may be intended that the screening profile covers at least the frontal surface of the pressure beam.

Preferably, the screening profile extends at the lateral surface almost or completely over the vertical height of the covering panels. In this case, it may be that the screening profile, at the upper and/or lower ends, be configured slightly shorter than the covering panels. It may be for example that the covering panels, at the upper and/or the lower ends, be configured between 0.1 mm and 20 mm, preferably between 0.1 mm and 10 mm, particularly preferred between 0.1 mm and 5 mm longer than the screening profile. Hereby, it is achieved that, when the partitioning wall element becomes canted, only the soft covering panels will undergo canting and not the screening profile.

In addition or as an alternative, the screening profile, at the lateral surface, may cover the width of the covering panels thereof. Thus, the screening profile, at the lateral surface, may extend over the entire width and/or essentially over the vertical height of the covering panels. Hereby, the inside of the telescoping element is covered and protected by the screening profile. Different technical configurations inside the partitioning wall elements, which e. g. may originate from the fact whether or not the partitioning wall element and/or the telescoping element is/are manually displaced or motor-displaced, are not visible for the viewer. Hereby, the lateral surfaces of automatic and manual partitioning wall elements and/or partitioning wall installations may be similar to each other in aesthetical appearance, despite different constructions inside the telescoping element. This is in particular desired when combining manual and automatic partitioning wall installations in one room.

It is conceivable that the screening profile includes a covering element. In particular, the covering element forms the telescoping lateral surface. Preferably, the covering element extends at least sectionwise vertically with regard to the front side or backside of the partitioning wall element. Preferably, the covering element overlaps at least the pressure beam.

Preferably, the covering element is configured to be continuous, i. e. without any opening. The covering element may be configured with at least one panel-like section. An elastic sound absorber may be located at an exterior side of the covering element.

It is conceivable that an attaching element, e. g. a screw, for the attachment of the pressure beam to the drive device be disposed at the frontal surface of the pressure beam. Hereby, the pressure beam may be attached to the drive device in a particularly simple manner. Preferably, the attaching element is masked by the screening profile. Thus, the aesthetical impression will not be disturbed.

A retaining location is defined as a location, at which the screening holding means and the pressure beam holding means are positively connected. Preferably, the retaining location is disposed on the inside of the telescoping element.

In particular, the retaining location is not visible for the viewer of the partitioning wall element.

It may be provided that the screening holding means extends from the covering element towards the inside into the telescoping element. Preferably, the screening holding means is located on an inside of the covering element.

With the intention to provide the screening holding means in a technically simple manner, it may be intended that the screening holding means be incorporated integrally and/or from the same material, in particular monolithically, into the screening profile. Thus, the screening holding means may be connected integrally and/or from the same material, in particular monolithically, into the covering element. In addition or as an alternative, it is conceivable that the pressure beam holding means be incorporated integrally and/or from the same material, in particular monolithically, into the pressure beam. Hereby, the pressure beam may be manufactured in a mounting-friendly way.

Preferably, the screening profile is mountable, in particular latchable, to the pressure beam by means of a horizontal movement. Particularly preferred, the screening profile is mountable, in particular latchable, to the pressure beam only by means of a horizontal movement. Particularly preferred, the screening profile is clipped into the pressure beam. Hereby, in a technically simple manner, the screening profile may be mountable.

The screening profile and/or the pressure beam of the inventive partitioning wall element may be suitable for a utilization in both a manual partitioning wall element and in an automatic partitioning wall element, which results thereby in a considerable complexity reduction for the manufacturing and providing structural components for the partitioning wall installations.

Preferably, in a motor-deployable telescoping element, and/or a motor-displaceable partitioning wall element, at least one safety switch is disposed. The safety switch is provided for interrupting or for switching-off the motor drive device of the telescoping element and/or the motor drive of the entire partitioning wall element in the event of a contact of the telescoping element with an obstacle. Thus, when driving against an obstacle, a switching pulse is generated for the control of the partitioning wall element and/or of the telescoping element. Preferably, the safety switch is disposed at the frontal surface of the pressure beam. Preferably, the screening profile covers the safety switch.

The screening profile may be intended for actuating the safety switch. Preferably, it may be intended for achieving said functionality, that the screening holding means and the pressure beam holding means cooperate in such a way that the screening profile is disposed to be mobile opposed to the telescoping direction in relation to the pressure beam. Hereby, it is conceivable that the screening holding means and the pressure beam holding means may be disposed with regard to each other without form closure opposed to the telescoping direction. In particular, the screening holding means may be disposed spaced apart from the pressure beam that the safety switch may be actuated, in particular by means of a movement of the screening profile opposed to the telescoping direction. Thus, the screening profile functions as an actuating means for the safety switch. Disposed in such a way, the screening profile may take up an exemption position, in which the safety switch is not actuated, and at least one actuating position, in which the safety switch is actuated and generates a switching pulse for interrupting or switching-off the motor drive or the motor drive device.

Purely as an example, the screening profile may be mobile for actuating the safety switch via an actuating path W of 2 mm≤W≤20 mm, preferably of 3 mm≤W≤15 mm, particularly preferred of 4mm≤W≤10 mm.

Preferably, the screening holding means may be reversibly actuated. This means, that the screening profile may be moved back and forth between the exemption position and the actuating position.

It is conceivable that a spring element, which charges the screening profile with a force, which is directed away from the pressure beam, be disposed between the screening profile and the pressure beam. The spring element may serve for keeping the screening profile in the exemption position, as long as it is free from contact with the obstacle. In addition or as an alternative, the spring element may serve for moving the screening profile from the actuating position into the exemption position.

So that the spring element is able to move the screening profile into the exemption position, it may be intended, that the screening holding means and the pressure beam holding means are configured to be without form closure with regard to each other in the actuating position in the telescoping direction.

The spring element may be attached to the frontal surface of the pressure beam, e. g. screwed thereto. In particular, the spring element is configured as a leaf spring. There may be also several spring elements distributed over the frontal surface of the pressure beam. Preferably, the screening profile overlaps the spring element, respectively the spring elements.

In particular, a microswitch may be intended as the safety switch. In addition, at least one magnetically operable switch may be attached, in particular glued, on the inside to the screening profile, in particular on the inside of the covering element. The magnetically operable switch, e. g. a Reed switch, may serve for distinguishing between an obstacle and the terminal position of the partitioning wall element, e. g. at a building wall. Hereby, magnets are disposed at or in the building wall, which magnets may cooperate with the magnetically operable switch. Close to the terminal position, the magnetically operable switch may allow for overriding the switching pulse of the safety switch and thereby allow for a further deployment of the telescoping element into the terminal position. Hereby, it is possible to achieve a sufficient strong contact pressure for sound protection and/or for bracing the partitioning wall in the terminal position. Preferably, the screening profile is formed in such a manner that the magnetically operable switch is invisible for the viewer.

Preferably, the same screening profile is also usable for a manually deployable telescoping element. For this purpose, it may be intended that the pressure beam holding means and the screening holding means cooperate in such a manner that, in a first position, the screening profile may be retained in or at the pressure beam, in particular may be latched, in which in particular a first distance A1 between a first abutment section of the pressure beam and the screening profile is formed, and in a second position, may be retained, in particular latched, in or at the pressure beam, in which in particular a second distance A2 between the first abutment section of the pressure beam and the screening profile is formed. In this case, the screening profile may be retained at the pressure beam respectively in the telescoping direction. In other words, in a first position and in a second position, the screening profile may be retained, in particular may be latched, at or in the pressure beam in the telescoping direction, wherein in the first position, the screening profile occupies a first distance A1 opposed to the telescoping direction with regard to the pressure beam, and in the second position, a second distance A2 opposed to the telescoping direction with regard to the pressure beam. In the second position, the screening profile may have a larger distance to the pressure beam than in the first position. The distance A2 may be larger than the distance A1.

With the first distance A1, which is configured for example with a manually deployable telescoping element and/or for a manually displaceable partitioning wall element, the screening profile may be essentially affixed to the pressure beam, whereas with the second distance A2, which is given in particular with a motor-deployable telescoping element and/or a motor-displaceable partitioning wall element, the screening profile may be supported to be mobile, in particular resiliently, with regard to the pressure beam. Hereby, in particular the same screening profile may be utilized for both manual and automatic partitioning wall elements, which results in a considerable complexity reduction in the structural components required for forming a partitioning wall element.

The second position may correspond to the exemption position. However, in particular, the first position does not correspond to the actuating position. Even though, in one of the potential actuating positions, preferably the abutment section and the screening profile may have a similar or the same distance A1 with regard to the pressure beam as in the first position. However, it is preferred in the actuating position, the screening profile, other than in the first position, not be retained at the pressure beam in the telescoping direction.

In particular, in the first position, the screening profile is immobilized opposed to the telescoping direction. In other words, in the first position, the screening profile is movable only a little bit or not at all opposed to the telescoping direction. Thus, the screening profile may be movable e. g. only over less than 2 mm, preferably less than 1 mm, particularly preferred less than 0.5 mm opposed to the telescoping direction.

It may be that, in the first position and/or in the actuating position, opposed to the telescoping direction, the screening profile abuts against the rest of the telescoping element, in particular against the pressure beam and/or against the covering panels. In this case, the screening profile may directly abut. For example a distal end of the screening holding means may abut against the pressure beam. As an alternative or in addition, in the first position and/or in the actuating position, the screening profile and the pressure beam may abut against each other via a spring elastic element, e. g. a sealing band. Hereby, any interfering noise development may be prevented. Moreover, the spring-elastic element may exert a force onto the form closure of the screening holding means with the pressure beam in the telescoping direction.

The pressure beam may comprise a first abutment section and a second abutment section, against which the screening profile may abut, in particular the covering element, preferably with intermediate arrangement of respectively one spring-elastic element. Thus, via at least two spring-elastic elements, the pressure beam and the screening profile may abut against each other in the first position and/or in the actuating position.

Preferably, achieving the first position starting from the second position is prevented by means of a movement of the screening profile opposed to the telescoping direction. As, in the first position, the screening profile is retained, in particular positively, in the telescoping direction, a movement starting from the second position, i. e. the exemption position, into the first position, is conflicting with a reversibility of the switch actuation.

It is conceivable that, in a first mounting position and in a second mounting position, the screening profile may be disposed at the pressure beam, wherein the screening profile in the second mounting position is located as rotated about a horizontal axis as compared to the first mounting position. In particular, in this case the screening profile is rotated about 180°. Preferably, the first mounting position is intended for the screening profile to occupy the first position, and the second mounting position is intended for the screening profile occupying the second position.

Particularly preferred, the screening profile may only occupy the first position in the first mounting position and/or the screening profile may only occupy the second position in the second mounting position. Hereby, the screening profile and/or the pressure beam may be configured asymmetrically with regard to a vertical central plane of the partitioning wall element. In the first mounting position, the screening holding means may cooperate with a first pressure beam holding means and in the second mounting position, the screening holding means may cooperate with a further pressure beam holding means, which, in particular to the first pressure beam holding means, is asymmetrically with regard to the central plane. This configuration allows in particular that in an actuating position albeit the same distance A1 may be occupied, however without occupying the first position.

It is conceivable that at least two retaining locations be provided, at which respectively one screening holding means and one pressure beam holding means cooperate, wherein the retaining locations are horizontally spaced apart from each other. Hereby, a mechanically wobble-reduced arrangement of the screening profile at the pressure beam may be achieved. In particular, both in the first position and in the second position, respectively two retaining locations are provided. Thus, a wobble-reduced arrangement may be achieved for both the fully automatic, semi-automatic and manual partitioning wall elements. Particularly preferred, three retaining locations are intended by means of which in the first position and in the second position respectively two retaining locations are provided. Thus, one retaining location will find its utilization both in the first and in the second positions. The at least two retaining locations may be disposed at the same distance to the vertical central plane of the partitioning wall element.

Preferably, the same at least two screening holding means, i. e. the first and the second screening holding means cooperate in the first position and in the second position with pressure beam holding means.

Preferably, it is intended that the screening holding means in the vertical direction extend over the screening profile and/or the pressure beam holding means in vertical direction over the pressure beam. Hereby, the functional safety of the partitioning wall element may be increased, because a rotation of the screening profile with regard to the pressure beam is prevented. The screening holding means and/or the pressure beam holding means are preferably configured to be continuous in vertical direction. As an alternative, the screening holding means and/or the pressure beam holding means include preferably interruptions in regular intervals. These alternatives allow for simply adapting the pressure beam and/or the screening profile to different vertical heights of the covering panels. Particularly preferred, the pressure beam is formed extruded with the pressure beam holding means and/or the screening profile with the screening holding means.

It may be intended that the screening profile be prevented from vertical displacement by means of the spring-elastic element. Hereby, the screening profile and/or the pressure beam are pressed in such a manner against the spring-elastic element that a vertical displacement is prevented by adhesive friction. This solution is chosen in particular for a screening profile in the first position and/or in an actuating position.

Such an adhesive friction may be lacking in the second position. It is conceivable that the screening profile includes a holder, which rests on the spring element. Hereby, the screening profile may be prevented from a vertical displacement in the second position and/or in an actuating position. It is likewise conceivable that the screening profile be equipped with a manual partitioning wall element with a spring element. Said equipment may serve for reducing noise and/or for preventing a vertical displacement.

Preferably, the screening profile includes lateral parts, which overlap the covering panels of the telescoping element, in particular on the front and back sides of the telescoping element. Hereby, an aesthetical gap-free transition between the screening profile and the covering panels is achieved. In particular, the lateral parts are formed in that the lateral parts overlap the covering panels of the partitioning wall element in both the first position and in the second position and/or along the actuating path.

Furthermore, it may be intended that the first screening holding means comprises a first web and the second screening holding means a second web. The first and second webs may be in particular spaced apart horizontally to each other and/or extend in the vertical, respectively over the screening profile. Hereby, it is achieved that a particularly simple and functional safe embodiment of the screening holding means is allowed.

Moreover, it may be intended that the first web and the second web extend parallel to each other. Hereby, it is achieved that a simple and safe mounting and retaining of the screening profile is allowed, in particular in both the first and the second mounting positions. As an alternative or in addition, the first web and the second web may extend parallel to the vertical central plane of the screening profile. For example, the first web and the second web may have the same distance to the vertical central plane.

Furthermore, it may be intended that the first web and the second web have an essentially identical horizontal height H. Hereby, it will be achieved that a simple and safe retaining of the screening profile is allowed, for example by means of a simple introduction of the screening holding means. Moreover, the first web and the second web may reach abutment against the screening beam such that the covering element may be disposed vertically to the covering panels.

The first web and/or the second web of the screening profile may be configured to be elastically bending. Hereby, the screening profile may be clipped onto the pressure beam in a simple manner.

It may be intended that the first screening holding means includes a form closure means formed at the web, in particular a latching projection protruding from the first web, and the second screening holding means includes a second form closure means formed at the second web, in particular a second latching projection protruding from the second web. The form closure means, e. g. the groove or latching projection, may be disposed in particular in that the form closure means cooperate with the pressure beam holding means in both the first and the second mounting positions. Hereby, it will be achieved that the screening profile is retained in a material saving and safe manner.

Furthermore, it may be intended that the first form closure means, in particular the first latching projection, be disposed at a first height H1 at the first web and the second form closure means, in particular the second latching projection, at a second height H2 at the second web, wherein the first height H1 is different from the second height H2. The distance of the form closure means to the covering element is referred to as the height H1, H2. Hereby, for example the first position of the screening profile and the second position of the screening profile may be realized in or at the pressure beam.

The first latching projection may be disposed at the distal end of the first web. Hereby, it will be achieved that the disposition of a first latching projection at the distal end of the first web allows for a particularly simple clipping-in of the screening profile on account of the high flexibility. As an alternative or in addition, the second latching projection of the second web may be disposed below the disposed end of the second web. Hereby, it is possible that the distal end of the second web acts as an abutment, by means of which a retaining in the telescoping direction is prevented in the actuating position.

Furthermore, it may be intended that the pressure beam comprises a first walling section and a second wall section, at which the pressure beam holding means are disposed. The first and/or the second wall section/s may be configured in an L-shape, wherein in particular one branch of the "L" is located opposite a distal end of a web.

The first wall section of the pressure beam and the second wall section of the pressure beam may extend at least in one section essentially parallel to the first web of the screening profile and to the second web of the screening profile. Hereby, it will be achieved that a particularly simple and functionally safe guidance of the screening profile is guaranteed when latching with the pressure beam and/or on the actuating path. Preferably, the webs and the thereto corresponding wall sections are disposed spaced apart from each other, such that based on the lacking friction, no interfering noises will be generated.

Furthermore, it may be intended that the pressure beam holding means comprise a first pressure beam holding means, a second pressure beam holding means and a third pressure beam holding means, wherein preferably the first pressure beam holding means and the second pressure beam holding means are disposed at the first wall section of the pressure beam, as well as the third pressure beam holding means is disposed at the second wall section of the pressure beam. Preferably in this case, the first, the second and the third pressure beam holding means are disposed in different heights with regard to the covering element.

It may be intended that the height difference between the first and the second screening holding means corresponds to the height difference between the first and the third pressure beam holding means and/or that the height difference between the first and the second screening holding means corresponds to the height difference between the second and the third pressure beam holding means. Hereby, it will be achieved for example that the first position of the screening profile and the second position of the screening profile may be realized in or at the pressure beam, wherein these defined positions may be produced by means of a 180° rotation of the screening profile. For this purpose, preferably only one pressure beam holding means is provided at one of the wall sections and/or only two screening holding means are provided.

Furthermore, it may be intended that the screening profile extend essentially vertically to the vertical central plane of the partitioning wall element. Hereby, it will be achieved that a particularly aesthetical appearance of the lateral surface is obtained, as well as a safe functioning of the partitioning wall element when the lateral surface is abutting against the building wall or the attaching abutment.

BRIEF DESCRIPTION OF THE DRAWINGS

Hereinafter, the disclosure will be explained in more detail, on the basis of exemplary embodiments. Technical features having the same function are numbered in the Figures with the same reference numerals. In the drawings.

DETAILED DESCRIPTION OF THE DRAWINGS

Figure 1:
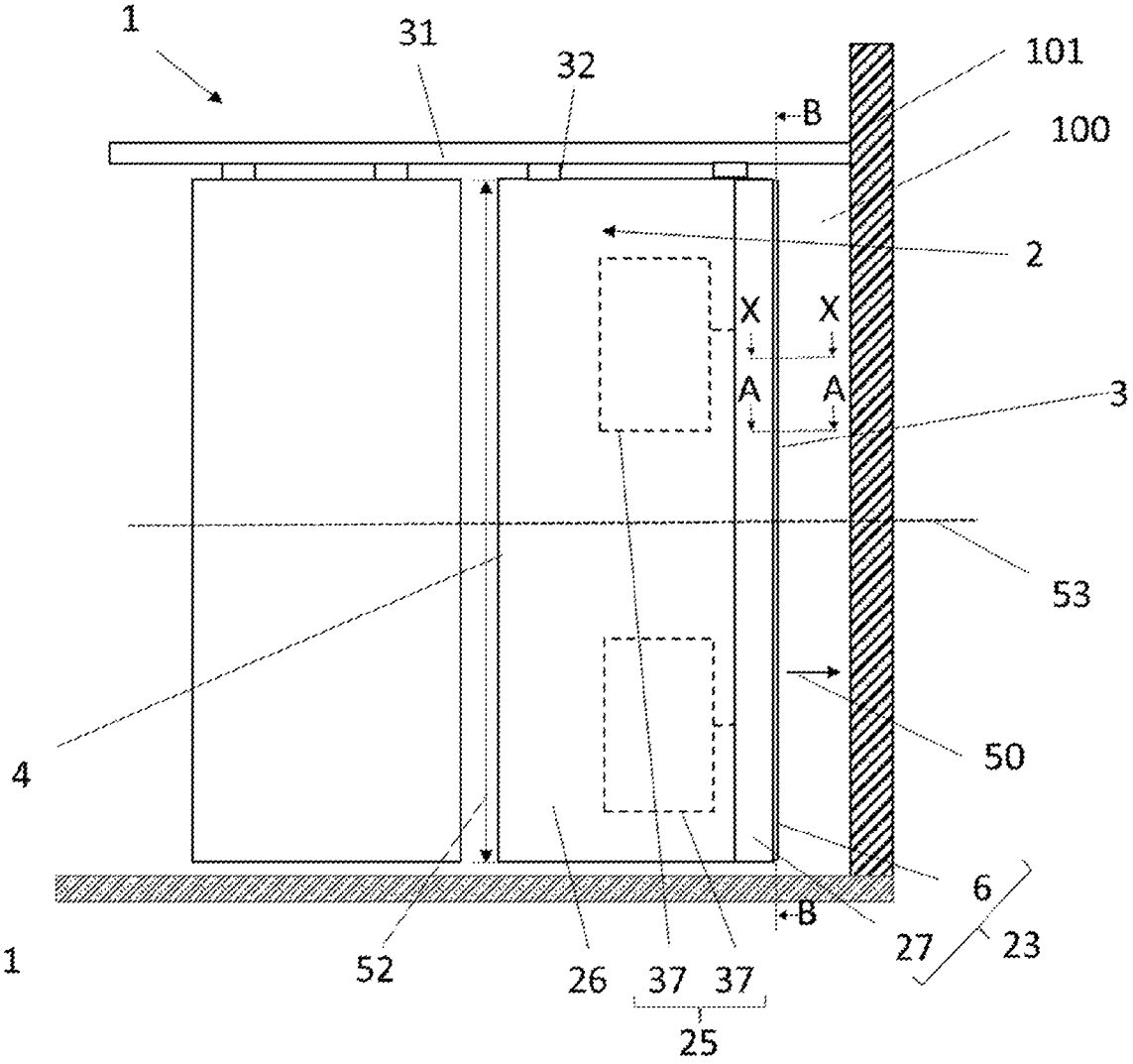
FIG. 1 shows an inventive partitioning wall installation with an inventive partitioning wall element in a frontal view.

FIG. 1 depicts a low-level diagrammatic illustration of an inventive partitioning wall installation 1 and of an inventive partitioning wall element 2 of the partitioning wall installation 1 when mounting a partitioning wall. The partitioning wall element 2 is guided in a track 31 for example at the ceiling via running rollers 32 and comprises a non-illustrated ceiling-sided and floor-sided sealing strip. The sealing strips are deployable against the ceiling, respectively the floor for a sound-proof termination and may brace the partitioning wall element 2.

The partitioning wall element 2 includes a first vertical lateral surface 3 and a second vertical lateral surface 4, wherein the first lateral surface 3 in the illustrated exemplary embodiment of FIG. 1 may be telescoping.

For this purpose, the partitioning wall element 2 comprises a telescoping element 23 deployable in a horizontal direction, which—in the plane of the image of FIG. 1—is deployable to the right hand side in a telescoping direction according to the arrow 50. The deployment movement of the telescoping element 23 with regard to the rest of the partitioning wall element 2 is generated by means of a drive device 25, which is manually actuatable and/or motor-actuatable and, in this case, is purely diagrammatically illustrated and in FIG. 1 covered by means of an encasing panel 26. By way of example the drive device 25 includes two deployment units 37. The drive device 25 comprises a manual drive and/or electromotive drive (not illustrated), which may be incorporated into one of the deployment units 37 or may be disposed between the deployment units. Each deployment unit 37 may comprise for example a spindle nut, which is driven by means of the manual and/or electromotive drive via a spindle. The spindle nut may be connected for example via a scissor-arm assembly to the telescoping element 23. In each deployment unit 37, the rotation of the spindle moves the spindle nut along the spindle, such that the telescoping element 23 moves in horizontal direction laterally out of the rest of the partitioning wall element 2, such that the telescoping element 23 is able to occupy a deployed condition II. The telescoping element 23 may be likewise retracted by means of the drive device 25 and occupy a retracted condition I. In FIG. 1 the telescoping element 23 is illustrated in the retracted condition I.

In FIG. 1, the telescoping element 23 comprises a concealed and in the FIGS. 2 to 5 an illustrated pressure beam 5, which is coupled to the drive device 25. Furthermore, the pressure beam 5 is connected to the covering panels 27 of the telescoping element 23, of which one covering panel 27 is illustrated in FIG. 1. In the retracted condition I, the covering panels 27 partially conceal the encasing panels 26. Via the pressure beam 5, the covering panels 27 are laterally deployed or retracted again by means of the drive device 25. By deploying the telescoping element 23 a gap 100 between the stationary wall 101 and the partitioning wall element 2 may be closed. With the gap being closed, the telescoping element 23 is in the deployed condition II. Hereby, a visual protection and a sound protection are achieved. Even though, in the FIGS. 2 to 5 for the sake of clarity, respectively only one covering panel 27 or encasing panel 26 is illustrated, nevertheless respectively opposite covering panels 27 and encasing panels 26 are provided.

Figure 2:
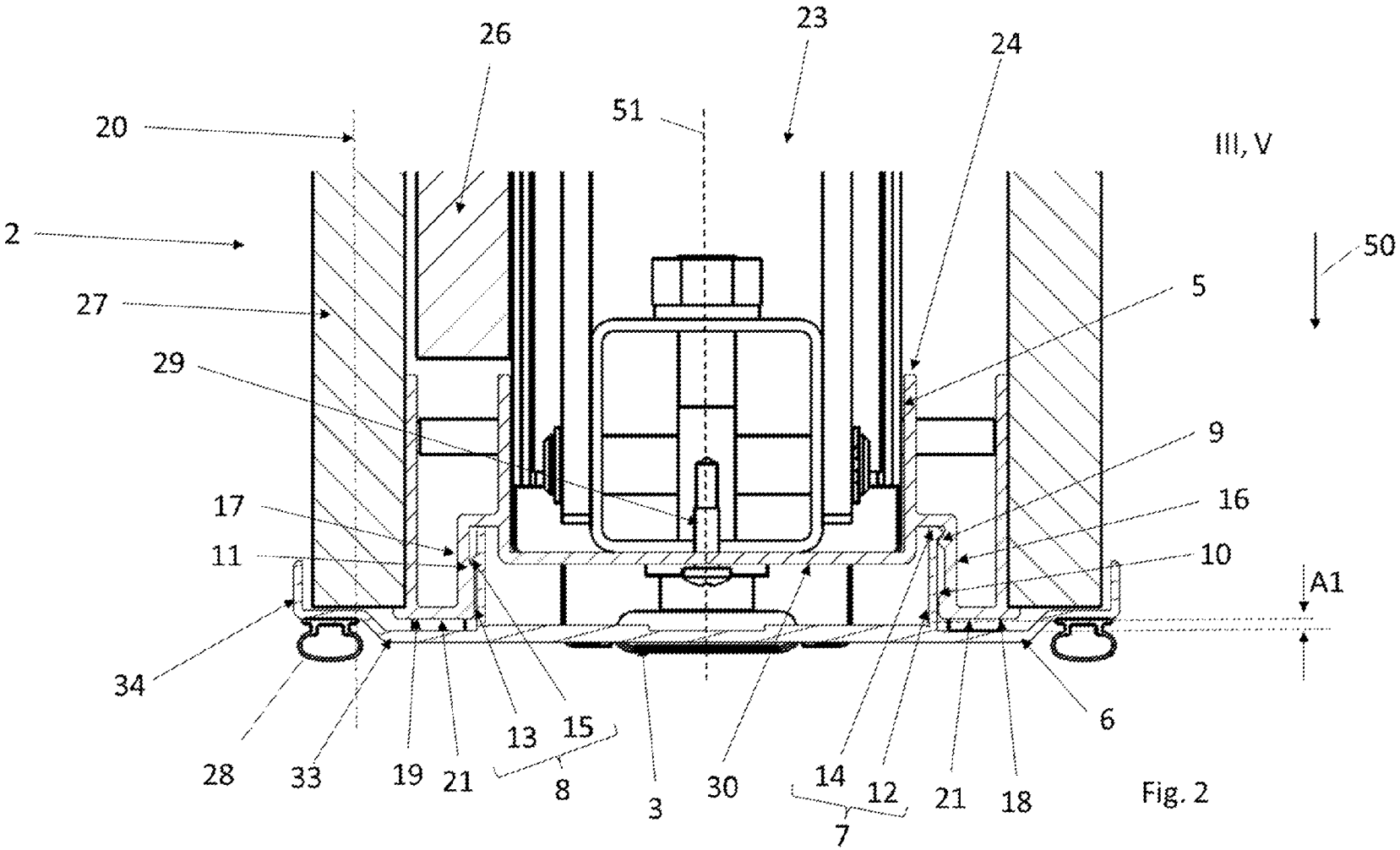
FIG. 2 shows a cross-sectional view through an inventive partitioning wall element with a manually deployable telescoping element according to A-A of FIG. 1.
Figure 3:
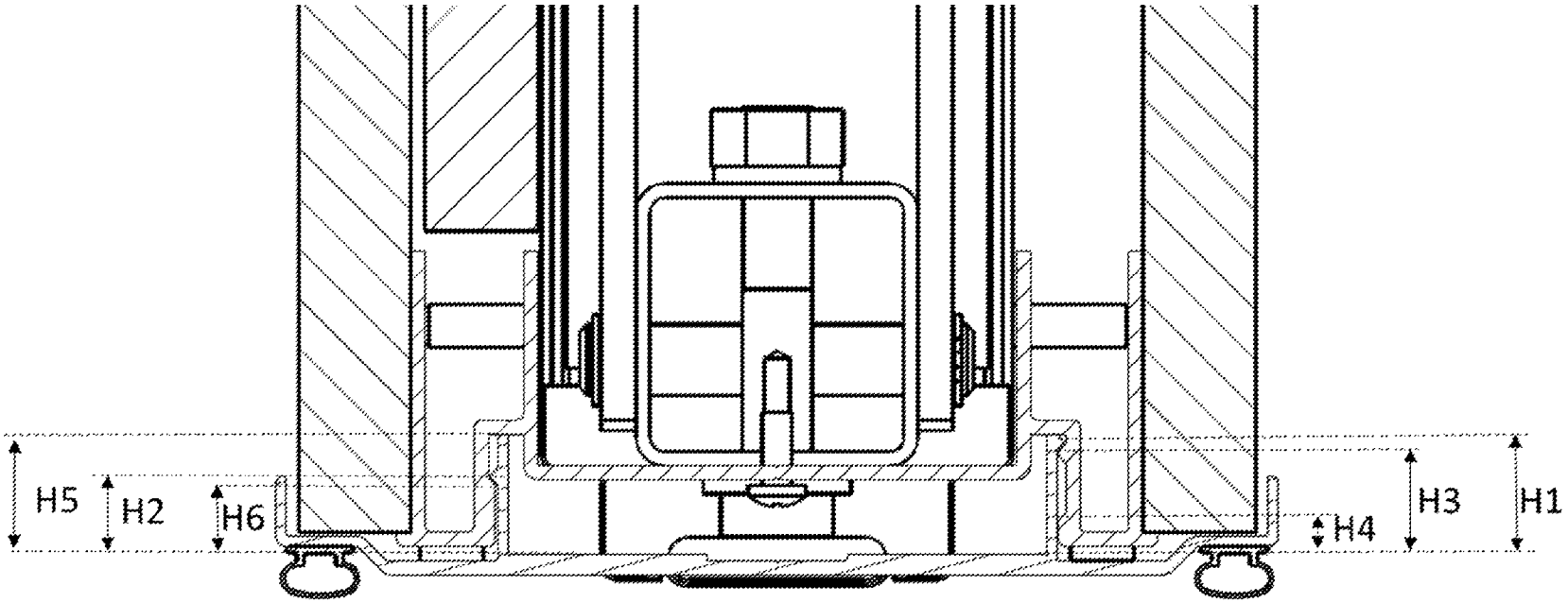
FIG. 3 shows the same view as in FIG. 2, in which the heights H1 to H6 are illustrated.
Figure 4:
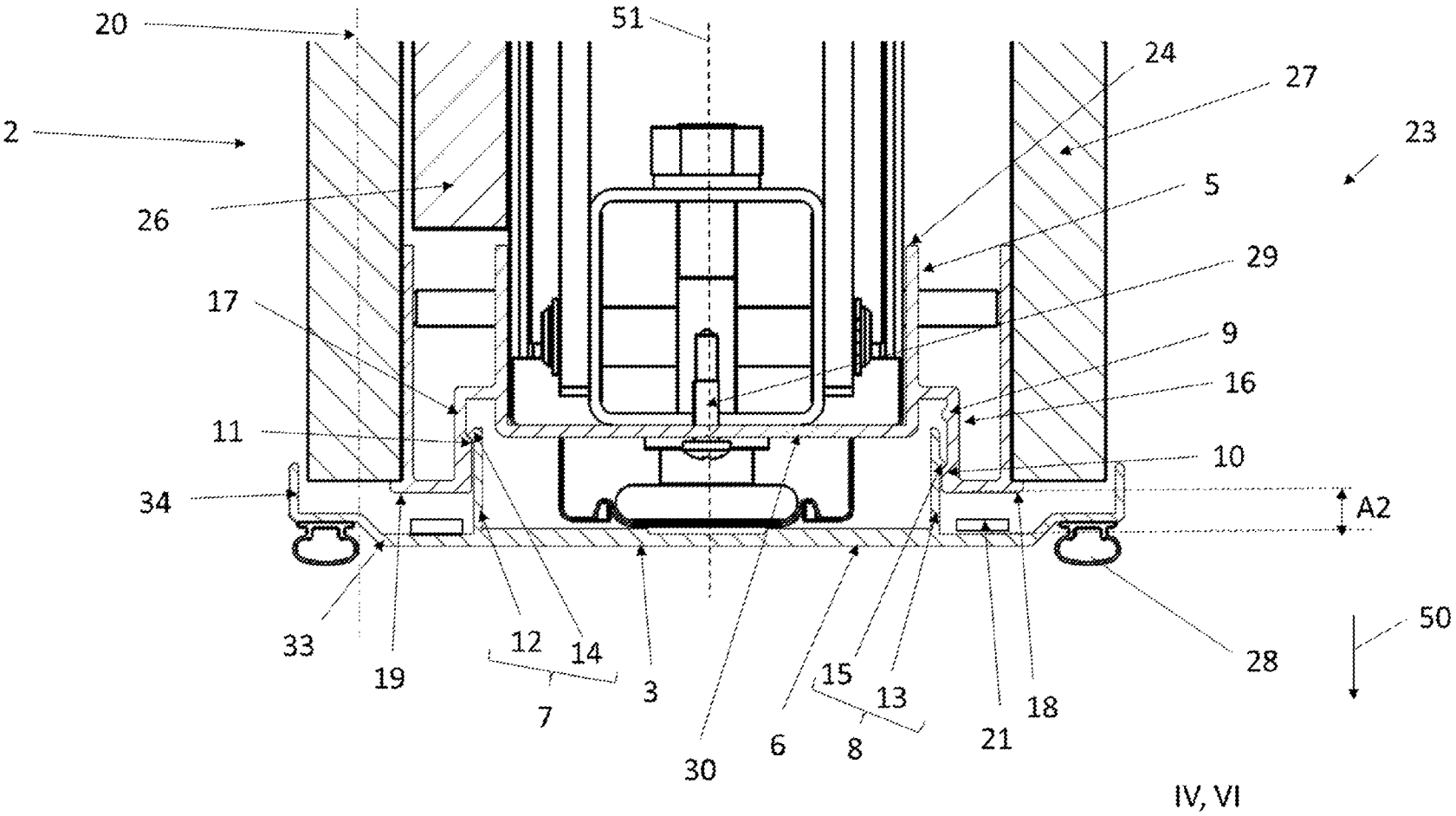
FIG. 4 shows a cross-sectional view through an inventive partitioning wall element with an automatically deployable telescoping element in an exemption position according to A-A of FIG. 1.

As illustrated in the FIGS. 2 to 4, the pressure beam 5 is preferably configured as a profile, which is in particular extruded or formed by extrusion. The pressure beam 5 is screwed to the drive device 25 at a frontal surface 30 of the pressure beam 5 by means of an attachment element 29. Thereby, the machining expense, when manufacturing the pressure beam 5, is omitted or reduced.

According to the disclosure, a screening profile 6 is provided, which forms the lateral termination of the telescoping element 23 and covers the pressure beam 5. The screening profile 6 together with the hollow chamber seals, acting as an elastic sound absorber 28, illustrated in the FIGS. 2 to 5, forms the lateral surface 3 of the partitioning wall element 2. The screening profile 6 is masked by the attaching element 29. Hereby, it is possible that, despite the simple manufacturing of the pressure beam 5, the partitioning wall element 2 features a pleasing aesthetical design.

As illustrated in FIG. 1, the screening profile 6 extends essentially over the entire vertical height 52 of the covering panels 27. The screening profile 6 is extruded. Thereby, the screening profile 6 may be easily adapted to the vertical height of the covering panels 27.

As illustrated in the FIGS. 2 to 5, a first and a second screening holding means 7, 8 are formed monolithically with the rest of the screening profile 6. The screening holding means 7, 8 extend over the entire vertical height of the screening profile 6. Correspondingly, the pressure beam holding means 10, 11 are monolithically formed with the rest of the pressure beam 5. The pressure beam holding means 9, 10, 11 extend over the entire vertical height of the pressure beam 5. Hereby, the screening profile 6 and the pressure beam 5 are simply scalable and reliably retained at each other. By incorporating the screening holding means 7, 8 into the screening profile 6 and incorporating the pressure beam holding means 9, 10, 11 into the pressure beam 5, in a technical simple manner, the screening profile 6 is retained at the pressure beam 5. The screening holding means 7, 8 extend into the inside of the telescoping element 23. Hereby, the retaining locations, which are formed by means of the screening holding means 7, 8 and the pressure beam holding means 9, 10, 11 and which form the support of the screening profile 6 at the pressure beam 5, are not visible.

Depending on the embodiment of the drive device 25, the inventive partitioning wall element 2 according to FIG. 1 may include a motor-deployable telescoping element 23 or a manually deployable telescoping element 23. In the deployed condition II, the partitioning wall element 2 with the motor-deployable telescoping element 23 and the partitioning wall element 2 with the manually deployable telescoping element 23 are identical from the outside. As long as no obstacle is present, in the retracted condition I according to FIG. 1, the screening profile 6 of the motor-deployable telescoping element 23 overlaps somewhat less with the covering panels 27 than the screening profile 6 of the manually deployable telescoping element 23, as shown when comparing the FIGS. 2 and 4. Otherwise, the exterior impression is also identical in the retracted condition I. Hereby, fully automatic, semi-automatic and manual partitioning wall elements 2 are identical in their exterior appearance. Thus, the screening profile 6 overlaps for example the spring elements 22, the safety switch 35 and/or the Reed switch 36 of a motor-deployable telescoping element 23. Hereby, the spring elements 22, the safety switches 35 and/or the Reed switches 36 are not visible to the viewer. The spring elements 22, the safety switches 35 and/or the Reed switches 36 are disposed on the inside of the telescoping elements 23.

Figure 5:
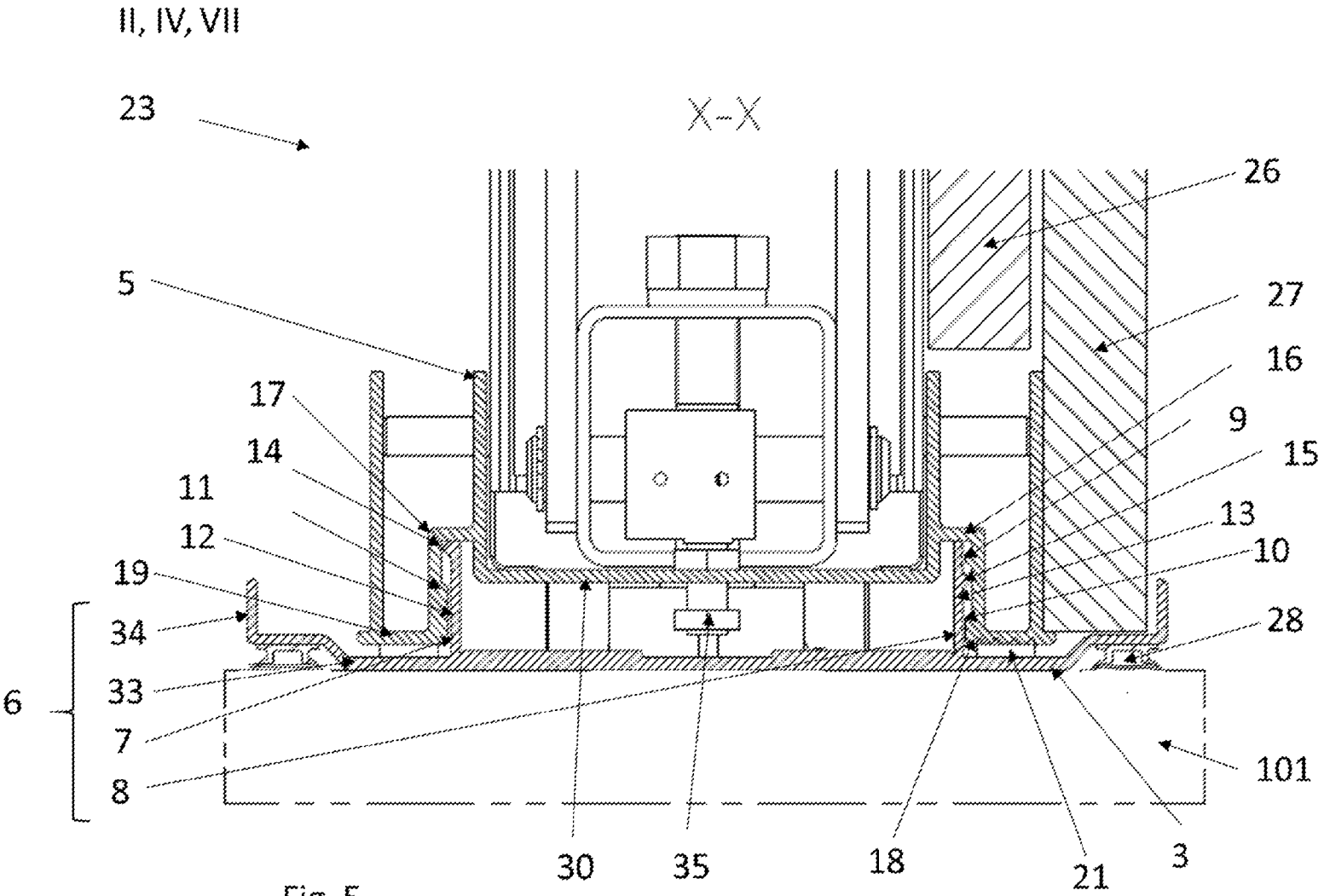
FIG. 5 shows a cross-sectional view through an inventive partitioning wall element with an automatically deployable telescoping element of FIG. 4 in an actuating position according to X-X of FIG. 1.

The FIGS. 2 to 4 show a cross-sectional view of the partitioning wall element 2 of FIG. 1 according to the line A-A. The FIG. 5 shows a cross-sectional view of the partitioning wall element of FIG. 4 according to the line X-X of FIG. 1. Hereby, in the FIGS. 2 and 3, a partitioning wall element 2 with a manually deployable telescoping element 23 and in the FIGS. 4 and 5 a partitioning wall element 2 with a motor-deployable telescoping element 23 are illustrated. As illustrated in the FIGS. 2 to 5, the same screening profile 6 may be employed in both the manual and in the motor-deployable telescoping element 23. For this purpose, in the FIGS. 2 and 3, the screening profile 6 is located in a first mounting position III and in the FIGS. 4 and 5, it is located in a second mounting position IV. In the first mounting position III, the screening profile 6, when compared to the screening profile 6 in the second mounting position IV, is rotated by 180° about a horizontal axis 53. In a motor-deployable telescoping element 23, likewise the pressure beam 5 is the same as in a manually deployable telescoping element 23. Thus, the utilization of the same components allows for keeping the multiplicity of variants and therefore the stock for the inventive partitioning wall element 2 very low. Moreover, an exchange of a manual drive device 25 against a motor-driven drive device 25, mounting the safety switches 35, the Reed switches 36 and, if required, the spring elements 22 and a 180° rotation of the screening profile 6, allows in a simple manner for converting the partitioning wall element 2 with a manually deployable telescoping element 23 to a partitioning wall element 2 with a motor-deployable telescoping element 23.

As respectively illustrated in the FIGS. 2 to 5, the pressure beam 5 has a U-shaped basic profile 24, at which a first L-shaped wall section 16 and a second L-shaped wall section 17 of the pressure beam 5 are disposed. A first pressure beam holding means 9 and a second pressure beam holding means 10 are formed at the first wall section 16. A third pressure beam holding means 11 is formed at the second wall section 17.

A first abutment section 18 adjoins the first L-shaped wall section 16 and a second abutment section 19 adjoins the second L-shaped wall section 17. The first abutment section 18 and the second abutment section 19 extend rectangularly to the L-shaped wall sections 16, 17 such that the short branch of an L-shaped wall section 16, 17 extends parallel to the abutment section 18, 19.

The screening profile 6 is disposed in a captive manner in or at the pressure beam 5. For this purpose, the screening profile 6 includes the first screening holding means 7 and the second screening holding means 8. The first and the second screening holding means 7, 8 are horizontally spaced apart. In the exemplary embodiment of FIGS. 2 to 5 shown, the first screening holding means 7 is formed from a first web 12, a first latching projection 14 being disposed at the distal end thereof. The second screening holding means 8 comprises a second web 13, wherein the first web 12 and the second web 13 almost present the same height H5, as illustrated in FIG. 3. A second latching projection 15 is disposed at the second web 13. The webs 12, 13 are configured such as to be elastically bending, i. e. for example upon inserting the screening profile 6 in or at the pressure beam 5, the embodiment of the wall sections 16, 17 causes them to elastically pivot towards each other. Hereby, the screening profile 6 may be clipped into the pressure beam 5 by means of a horizontal movement. Once clipped in, the screening holding means 7, 8 engage in a form closure with the pressure beam holding means 9, 10, 11 in the telescoping direction 50. Hereby, the screening profile 6 is latched at the pressure beam 5.

The pressure beam holding means 9, 10, 11 and screening holding means 7, 8 are configured to be asymmetrically with regard to a central plane 51. Hereby, it is possible that in the first mounting position III, the screening profile 6 takes up a first position V with regard to the pressure beam 5, which is illustrated in the FIGS. 2 and 3, whereas in the second mounting position IV, the screening profile 6 occupies a second position VI with regard to the pressure beam 5, as illustrated in FIG. 4. Hereby, in the first position V, as well as in the second position VI, the latching projections 14, 15 are latched with the pressure beam holding means 9, 10, 11, such that the screening profile 6 is retained at the pressure beam 5 in the telescoping direction 50. It is visible, that, in the configuration shown in FIG. 4, the distance A2 between the screening profile 6 and the pressure beam 5, compared to the configuration with the distance A1 between the screening profile 6 and the pressure beam 5 shown in FIG. 2 has increased.

Depending on whether or not the first position V or the second position VI is occupied, the two screening holding means 7, 8 respectively latch with different pressure beam holding means 9, 10, 11. In the first position V, the first screening holding means 7 is in engagement with the first pressure beam holding means 9 of the first wall section 16. In the first position V, the second screening holding means 8 is in engagement with the third pressure beam holding means 11 of the second wall section 17. However, in the second position VI, the first screening holding means 7 is in engagement with the third pressure beam holding means 11 of the second wall section 17 and the second screening holding means 8 is in engagement with the second pressure beam holding means 10 of the first wall section 16.

The asymmetry of the screening holding means 7, 8 and of the pressure beam holding means 9, 10, 11 results in the distance A1 of the first position V, which differs from the distance A2 of the second position VI. Hereby, the second latching projection 15 is disposed at a height H2 at the second web 13, whereas the height H2 is configured to be smaller than the height H1 of the first latching projection 14 of the first web 12. Correspondingly, the height H3 of the first pressure beam holding means 9 is larger than the height H6 of the third pressure beam holding means 11. In turn, the height H6 is larger than the height H4 of the second pressure beam holding means 10. In this case, the height difference H1–H2 of the latching projections 14, 15 corresponds to the height difference H3–H6 of the first and third pressure beam holding means 9, 11 as well as the height difference H6–H4 of the third and of the second pressure beam holding means 10, 11. Hereby, the heights H1 to H6 refer respectively to a covering element 33 of the screening profile 6.

So that the screening holding means 7, 8 may be clipped well in both the first and in the second mounting positions III, IV, the first and the second webs 12, 13 are aligned parallel to each other. The long branches of the first and second wall sections 16, 17 are configured to be parallel and spaced apart from the first and second webs, and serve as a guide for the latching projections 14, 15.

The screening profile 6 includes the panel-shaped covering element 33. Together with the hollow chamber profiles 28, the covering element 33 forms the lateral surface 3 of the partitioning wall element 2. In this case, the covering element 33 conceals the pressure beam 5. The covering element 33 extends essentially in vertical direction perpendicularly to a wall plane 20 and to the central plane 51 of the partitioning wall element 2. The surface of the screening profile 6 pointing to the outside is configured to be continuous and in an advantageous manner presents no attaching means, buttons or switches, which are visible from outside.

Lateral parts 34 adjoin the covering element 33, which parts, in a top view on the frontal or the back sides of the partitioning wall element, overlap a portion of the covering panels 27. Hereby, an overlapping is intended in such a manner that in both a first position V of the screening profile 6, which is shown in FIG. 2, and in the second position VI, which is shown in FIG. 4, a partial overlapping of the covering panels 27 is realized such that a transition between the covering element 33 and the covering panels 27 is respectively masked.

In the position of the screening profile 6 shown in FIG. 2, the screening profile is essentially fixed to the pressure beam 5 to be immobile.

With the intention to guarantee on the one hand an improved affixing by means of a pretension acting upon the latching, and to cause an acoustic uncoupling between the screening profile 6 and the pressure beam 5, a spring-elastic element 21 is disposed in the area of the first abutment section 18 and preferably also in the area of the second abutment section 19. This element may include a rubber-like sealing band. Moreover, the spring-elastic element 21 serves for the vertical affixing of the screening profile 6 to the pressure beam 5. Hereby, the spring-elastic element 21 generates an adhesive friction, which prevents a vertical movement of the screening profile 6. Moreover, the abutment of the screening profile 6 via the spring-elastic element 21 against the pressure beam 5 prevents a movement of the screening profile 6 opposed to the telescoping direction, which movement appears to be considerable to the viewer. In addition, a movement of the screening profile 6 opposed to the telescoping direction is essentially prevented by means of abutment of the distal ends of the screening holding means 7, 8 against the short branches of the wall sections 16, 17 and/or an abutment of the covering element 33 against the covering panels 27.

However, in the arrangement shown in FIG. 4, the screening profile 6 is disposed to be mobile in the direction towards the pressure beam 5, i. e. opposed to the telescoping direction 50. In the event, during deployment, the screening profile 6 abuts against an obstacle, the screening profile 6 is moved opposed to the telescoping direction 50 and actuates the safety switch 35, which is attached to the pressure beam 5. The deployment of the telescoping element 23 may be interrupted hereby. So that the screening profile 6 is mobile, the screening holding means 7, 8 are configured in the second position VI opposed to the telescoping direction 50 without form closure to the pressure beam holding means 9, 10, 11. Likewise, the distal ends of the screening holding means 7, 8 are spaced apart opposed to the telescoping direction 50.

Figure 6:
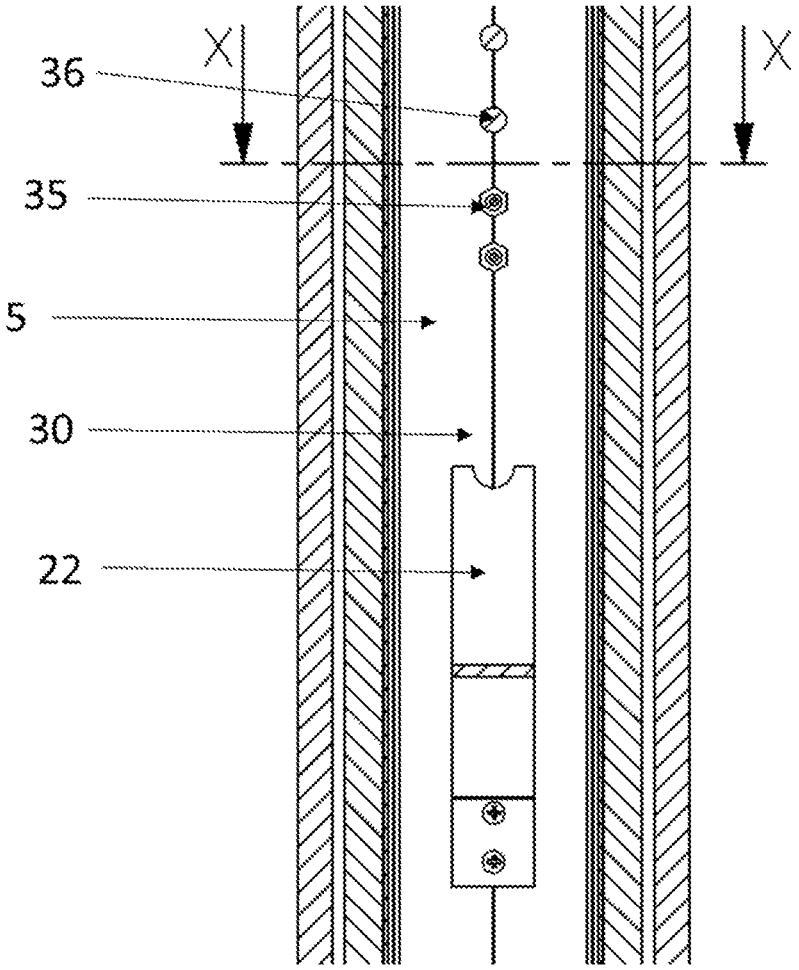
FIG. 6 shows a cut-out from a longitudinal section according to B-B of FIG. 1 for the exemplary embodiment depicted in FIGS. 4 and 5.

Spring elements 22 are disposed between the screening profile 6 and the pressure beam 5 (refer to FIG. 6), which charge the screening profile 6 with a force directed away from the pressure beam 5 and, in the second position VI shown in FIG. 3, press against the second pressure beam holding means 10 and the third pressure beam holding means 11. The obstacle may overcome said force such that the safety switch 35 may be actuated. As illustrated in FIG. 6, the spring elements 22 formed as leaf springs are attached to the frontal surface 30 of the pressure beam 5.

Thus, the second position VI illustrated in FIG. 4 corresponds to an exemption position, in which the screening profile 6 may be actuated opposed to the telescoping direction 50. In FIG. 5, the screening profile 6 is illustrated after having actuated the safety switch 35 in an actuating position VII. Moreover, the telescoping element 23 has reached a terminal position and therefore the deployed condition II and is abutting against the wall 101. In the actuating position VII, the screening profile 6 has the same distance A1 to the pressure beam 5 as in the first position V. Thus, the non illustrated seals may be employed to the same extend in a manually deployable telescoping element 23 as in a motor-deployable telescoping element 23 and they offer the same sound protection. However, the actuating position VII does not correspond to the first position V. In the actuating position VII, the screening profile 6 is rather not positively retained in the telescoping direction 50, but, on account of the force of the spring element 22 without cancelling the form closure, the screening profile 6 is able to move back into the exemption position according to FIG. 4. Thus, the safety switch 35 may be reversibly actuatable. With the intention to prevent a form closure of the second latching projection 15 with the pressure beam holding means 9, the distal ends of the webs 12, 13 are provided, which reach an earlier locating against the pressure beam 5. Thus, the distal ends of the webs 12, 13 serve as an abutment.

In addition to the safety switches 35, Reed switches 36 (refer to FIG. 6) are provided, which are attached on an inside of the covering element 33. The Reed switches 36 are provided for overriding an actuation of the safety switch 35 in the vicinity of the wall 101 and for indicating in such a way that it is not an unwanted obstacle, but the wall 101 to be reached that has been reached. The Reed switches 36, which cooperate with magnets disposed at the wall 101, therefore serve for distinguishing between an unwanted obstacle and the wall 101. When reaching the wall 101, unlike an unwanted obstacle, the deployment of the telescoping element 23 is not immediately interrupted, but continues until the actuating position VII illustrated in FIG. 5 has been reached with the same sealing effect.

With the intention to prevent a vertical displacement of the screening profile 6 into the second position VI according to FIG. 4, a holder, which rests upon the spring element 22, is attached on the inside at the screening profile 6.

The invention claimed is:

1. A partitioning wall element for a partitioning wall installation, wherein the partitioning wall element comprises a telescoping element deployable in a horizontal direction, wherein the telescoping element comprises a pressure beam and a screening profile, wherein the screening profile is retained in or at the pressure beam, wherein the screening profile includes at least one first screening holding means, which in a latching manner, cooperates with at least one corresponding pressure beam holding means of the pressure beam, wherein the pressure beam holding means and the screening holding means cooperate in such a manner that in a first position, the screening profile is retained in or at the pressure beam, in which a first distance between a first abutment section of the pressure beam and the screening profile is formed, and in a second position, the screening profile is retained in or at the pressure beam, in which a second distance between the first abutment section of the pressure beam and the screening profile is formed, wherein the screening profile includes lateral parts, which, at least one of (a) in the first and in the second positions and (b) over an actuating path, overlap covering panels of the partitioning wall element, wherein the pressure beam comprises the first abutment section and the second abutment section, against which the screening profile abuts with intermediate arrangement of a spring-elastic element.

2. The partitioning wall element according to claim 1, wherein the screening profile includes a covering element, from which the screening holding means extends towards the inside into the telescoping element, wherein the covering element extends at least partially vertically to at least one of (a) a wall plane of the partitioning wall element and (b) the covering element overlaps at least the pressure beam.

3. The partitioning wall element according to claim 1, wherein the screening holding means is at least one of (a) incorporated integrally and (b) made from the same material, monolithically with the screening profile.

4. The partitioning wall element according to claim 1, wherein the screening profile is mounted on the pressure beam by means of a horizontal movement.

5. The partitioning wall element according to claim 1, wherein the screening holding means and the pressure beam holding means cooperate such that the screening profile is disposed to be mobile opposed to the telescoping direction with regard to the pressure beam, wherein a spring element is disposed between the screening profile and the pressure beam, which element charges the screening profile with a force directed away from the pressure beam.

6. The partitioning wall element according to claim 1, wherein the screening profile is disposed at the pressure beam in a first mounting position and in a second mounting position, wherein, in the second mounting position, the screening profile is rotated about a vertical axis compared to the first mounting position, wherein, only in the first mounting position, the screening profile is able to occupy the first position, or only in the second mounting position the screening profile is able to occupy the second position.

7. The partitioning wall element according to claim 1, wherein at least one of (a) the screening holding means extend in a vertical direction beyond the screening profile and (b) the pressure beam holding means extend beyond the pressure beam in the vertical direction.

8. The partitioning wall element according to claim 1, wherein the pressure beam comprises a first wall section and a second wall section, at which the pressure beam holding means are disposed, wherein the first wall section of the pressure beam and the second wall section of the pressure beam, at least in one section, extend parallel to the first web of the screening profile and to the second web of the screening profile.

9. The partitioning wall element according to claim 1, wherein the pressure beam holding means comprise a first pressure beam holding means, a second pressure beam holding means, and a third pressure beam holding means, wherein the first pressure beam holding means and the second pressure beam holding means are disposed at the first wall section of the pressure beam, and the third pressure beam holding means is disposed at the second wall section of the pressure beam.

10. The partitioning wall element according to claim 1, wherein a second screening holding means is provided, wherein the first screening holding means comprises a first web and the second screening holding means a second web.

11. The partitioning wall element according to claim 10, wherein the first web and the second web extend parallel towards each other.

12. The partitioning wall element according to claim 11, wherein the first screening holding means includes a form closure means, which is configured at the web, a latching projection projecting from the first web, and the second screening holding means includes a second form closure means, which is configured at the second web, a second latching projection projecting from the second web, wherein the first form closure means is disposed at a first height at the first web and the second form closure means at a second height at the second web, wherein the first height is different from the second height.

* * * * *